US006444392B1

(12) United States Patent
Baker

(10) Patent No.: US 6,444,392 B1
(45) Date of Patent: Sep. 3, 2002

(54) BLACK AND WHITE GRAPHIC ARTS FILM

(75) Inventor: Julie Baker, Hertfordshire (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/928,215

(22) Filed: Aug. 10, 2001

(30) Foreign Application Priority Data

Sep. 30, 2000 (GB) ..... 0023979

(51) Int. Cl.[7] ..... G03C 1/06

(52) U.S. Cl. ..... 430/264; 430/373; 430/375; 430/449; 430/573; 430/578; 430/591; 430/593; 430/607; 430/613; 430/614; 430/615; 430/598

(58) Field of Search ..... 430/607, 613, 430/614, 615, 573, 578, 591, 593, 449, 264, 373, 375, 598

(56) References Cited

U.S. PATENT DOCUMENTS

| | | | | | |
|---|---|---|---|---|---|
| 5,116,722 | A | * | 5/1992 | Callant et al. | 430/363 |
| 5,221,604 | A | | 6/1993 | Mifune et al. | |
| 5,370,986 | A | | 12/1994 | Lok et al. | |
| 5,563,021 | A | * | 10/1996 | Pich et al. | 430/264 |
| 6,057,089 | A | * | 5/2000 | Matsumoto et al. | 430/584 |

FOREIGN PATENT DOCUMENTS

| | | | |
|---|---|---|---|
| JP | 3-171135 | * | 7/1991 |

* cited by examiner

*Primary Examiner*—Geraldine Letscher

(57) ABSTRACT

A black and white graphic arts film comprising a support having thereon at least one emulsion layer, said emulsion layer comprising:

a trinuclear merocyanine spectral sensitising dye;

2-methylthio-4-hydroxy-6-methyl-1,3,3a,7-tetraazaindene (SMe-TAI); and a photosensitive silver halide.

16 Claims, 3 Drawing Sheets

BLACK AND WHITE GRAPHIC ARTS FILM

FIELD OF THE INVENTION

This invention relates to black and white graphic arts films, and to photographic silver halide emulsions therefor.

BACKGROUND OF THE INVENTION

Black and white graphic arts films are often used with either a helium-neon (HN) or laser diode (LD) light source. The wavelength of HN light is 633 nm, while the wavelength of LD light is 670 nm and the installed base of image-setters with the different light sources varies from country to country.

In photographic films, spectral sensitising dyes are commonly used, the dyes being adsorbed to grains of silver halide in the emulsion layers. A sensitising dye induces sensitivity of the silver halide grains to longer wavelengths. In general, when a dye is used in an emulsion layer of a photographic film, the spectral region of sensitisation corresponds to the absorption spectrum of the adsorbed dye. For a given dye, a particular spectral speed is achieved. The spectral speed is related to the absorptance characteristics of the dye.

Fogging describes a phenomenon in the photographic process whereby localised areas of silver halide grains become reduced in the developing process, even when they have not been exposed to light. Antifoggants are chemicals which may be added to the emulsion layer of photographic film to decrease the rate of development of the photographic image in a selective manner.

A group of compounds which act as antifoggants (or stabilisers) are tetraazaindenes. These have been studied extensively (E. J. Birr, *Stabilisation of Photographic Silver Halide Emulsions*, Focal Press, London, 1974, Chapter IV). In particular, it has been found that 4-hydroxy-6-alkyl-1,3,3a,7-tetraazaindenes are useful stabilisers. The 6-methyl compound has been studied most extensively. U.S. Pat. No. 5,221,604 describes a silver halide photographic material comprising a support having thereon at least one silver halide emulsion layer. The silver halide is chemically sensitised by a chemical sensitiser promoter comprising at least one silver halide solvent and an adsorbable compound. The adsorbable compound may be selected from various tetraazaindenes, including 2-methylthio-4-hydroxy-6-methyl-1,3,3a,7-tetraazaindene (hereinafter sometimes referred to as "SMe-TAI").

U.S. Pat. No. 5,370,986 describes a photographic material comprising a silver halide emulsion layer. The emulsion layer comprises a water-soluble nonionic polyhydroxyalkyl compound, such as an oligosaccharide, and a co-stabilising agent, such as 2-methylthio-4-hydroxy-6-methyl-1,3,3a,7-tetraazaindene (SMe-TAI). This combination was found to be effective in reducing storage fog in the emulsion layer.

Neither of the above-mentioned Patents is directed to black and white graphic arts films.

PROBLEM TO BE SOLVED BY THE INVENTION

It is an object of the present invention to provide a black and white graphic arts film that is suitable for use on any LD or HN exposing device.

SUMMARY OF THE INVENTION

Accordingly, the present invention provides a black and white graphic arts film comprising a support having thereon at least one emulsion layer, said emulsion layer comprising:

(a) a trinuclear merocyanine spectral sensitising dye;

(b) 2-methylthio-4-hydroxy-6-methyl-1,3,3a,7-tetraazaindene; and (c) a photosensitive silver halide.

The present invention further provides a photographic silver halide emulsion suitable for preparing a black and white graphic arts film comprising (a), (b) and (c).

The present invention even further provides a photographic silver halide emulsion melt comprising (a), (b) and (c).

ADVANTAGEOUS EFFECT OF THE INVENTION

It has been found that this specific combination of ingredients in the emulsion layer provides significant advantages.

Hitherto, it was believed that the concentration of antifoggant or stabiliser in the emulsion layer had an insignificant effect on the absorptance characteristics of the sensitising dye. However, surprisingly it has now been found that SMe-TAI has a dramatic effect on the absorptance characteristics of a trinuclear merocyanine sensitising dye. In particular, the concentration of SMe-TAI in the emulsion layer has been found to affect the absorptance characteristics of the trinuclear merocyanine dye. Since the absorptance characteristics of a given dye are related to its spectral speed, this combination of ingredients allows the spectral speed of a trinuclear merocyanine dye to be modulated by adjusting the concentration of SMe-TAI in the emulsion layer.

In addition, it has been found that the concentration of SMe-TAI in the emulsion layer has an effect on the relationship between the HN and LD speeds for a trinuclear merocyanine dye. Hitherto, it was believed that the relationship between the HN and LD speeds is generally consistent for a particular spectral sensitising dye. Previously, the HN and LD speeds could be changed in absolute terms by the use of various antifoggants, but their relative speeds could not be altered. However, in the present invention, it has been found that the relative HN and LD speeds can now be changed. Accordingly, the ability to change the relative HN and LD speeds for the same spectral sensitising dye finds numerous applications. Most notably, it will allow the same spectral sensitising dyes to be used in a single film for both HN and LD applications when the speed requirements of the film might otherwise be unachievable due to the inability to change the relative HN and LD speeds. This has the advantages of greater convenience and lower production costs.

A further advantage of the present invention is experienced in the production process. When an emulsion layer for a photographic film is prepared, the emulsion is held in a melt at approximately 40° C., before it is coated onto a photographic support. The emulsion may be held in the melt for up to 12 hours. However, it has been observed that the characteristics of the melt can change over time. This change in melt characteristics is termed "emulsion melt drift". In particular, it has been observed that the spectral speed of the melt increases with time. An increase in spectral speed in an emulsion melt is undesirable, since the films produced will have inconsistent speeds, even when they are produced from the same emulsion melt. In the present invention, it has been found that the combination of SMe-TAI and a trinuclear merocyanine dye has an effect in reducing speed increases in the melt.

Various stabilisers have been proposed to control speed changes during long-term storage of undeveloped photographic films. However, a combination of chemicals which control speed changes in the emulsion melt has not been disclosed. Thus, the unique combination of a trinuclear merocyanine dye and SMe-TAI also has the advantage of producing films with a more consistent spectral speed from the same melt.

DETAILED DESCRIPTION OF THE INVENTION

Preferably, the amount of SMe-TAI in the emulsion melt is in the range of 0.05 to 0.2 g/Ag mole. It has been found that this concentration of SMe-TAI in the melt is very effective in controlling emulsion melt drift.

Preferably, the trinuclear merocyanine dye is a red sensitising dye. Trinuclear merocyanine dyes are known in the art (F. Hamer, *The Cyanine Dyes and Related Compounds*, Wiley-Interscience, 1964). All of the nuclei generally used in merocyanine dyes can be used for the basic heterocyclic nuclei in dyes of the present invention. The nuclei may be selected from a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus; a nucleus in which one of these nuclei is fused with an aliphatic hydrocarbyl ring, or a nucleus in which one of these nuclei is fused with an aromatic hydrocarbyl ring, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus. These nuclei may be substituted on carbon atoms.

Preferably, the trinuclear merocyanine dye is one which does not stain during processing i.e. a dye which washes out and does not leave colour on the film. More preferably, the non-staining trinuclear merocyanine dye is of formula (I):

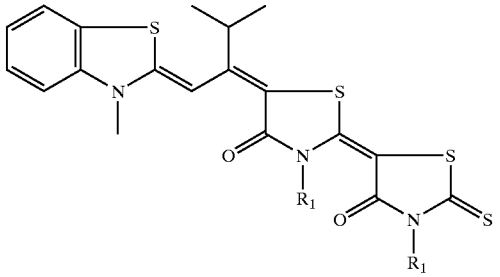

$R_1 = CH_2CO_2H$

The amount of sensitising dye used in the emulsion layer is preferably in the range of 100 to 1000 mg per mole of Ag. More preferably, the amount of dye is in the range of 200 to 600 mg/Ag mole, more preferably 300 to 500 mg/Ag mole. Most preferably the amount of sensitising dye in the emulsion layer is about 400 mg/Ag mole.

Preferably, the amount of SMe-TAI in the emulsion layer is in the range of from 0.05 to 1.5 g/Ag mole. Preferably, the amount of SMe-TAI in the emulsion layer is in the range of from 0.1 to 1.2 g/Ag mole, more preferably 0.1 to 0.8 g/Ag mole, and more preferably 0.1 to 0.4 g/Ag mole.

The types of photosensitive silver halide to which this invention may be applied include silver chloride, silver bromide, silver bromoiodide, silver chlorobromide, silver chloroiodide, silver chlorobromoiodide and mixtures thereof. The silver halide crystals may be coarse, medium or fine grains or mixtures thereof. The grains may be of different morphologies, e.g., spherical, cubic, cubooctahedral, tabular etc., or mixtures thereof. Grain size distribution may be monodisperse or polydisperse or mixtures thereof Preferably, the silver halide is silver chlorobromide, more preferably 70:30 chlorobromide. Preferably, the silver halide grains are cubic. The silver halide may, optionally, be doped with other metals such as rhodium or iridium.

Preferably the silver halide emulsion is chemically sensitised. Methods of chemically sensitising silver halide emulsions will be readily apparent to the person skilled in the art. These include, for example, those methods described in T. H. James, *The Theory of the Photographic Process,* 4th Ed., 1977, Ch. 5. Suitable methods of chemical sensitisation include, for example, the use of active gelatin, sulfur, selenium, thiocyanate derivatives, thioether compounds, tellurium, gold, platinum, palladium, iridium, osmium, rhenium, phosphorus, or combinations thereof. The silver halide emulsions may also be reduction sensitised using, for example, hydrogen, stannous chloride, thiourea dioxide, polyamines or polyboranes. Preferably, the silver halide emulsion is chemically sensitised using sulfur and/or gold compounds.

In one aspect of the present invention, the emulsion layer of the black and white graphic arts film comprises at least one antifoggant (or stabiliser). We have found that using excess SMe-TAI to achieve antifoggant effect can reduce its speed-modulation effect. Suitable antifoggant(s) will be known to the person skilled in the art and may be found in, for example, E. J. Birr, *Stabilisation of Photographic Silver Halide Emulsions*, Focal Press, London, 1974, Chapter IV. Suitable antifoggants may be selected from azaindenes (especially tetraazaindenes), tetrazoles, benzotriazoles, imidazoles and benzimidazoles. Specific examples of typical antifoggants include 5-carboxy-2-methylthio-4-hydroxy-6-methyl-1,3,3a,7-tetraazaindene, 1-(3-acetamidophenyl)-5-mercaptotetrazole, 4-hydroxy-6-methyl-1,3,3a,7-tetraazaindene, phenylmercaptotetrazole, 6-nitrobenzimidazole, 2-methylbenzimidazole and benzotriazole. In a preferred embodiment of the present invention the emulsion layer additionally comprises the antifoggants 5-carboxy-2-methylthio-4-hydroxy-6-methyl-1,3,3a,7-tetraazaindene (SMe-carboxy-TAI) and/or 1-(3-acetamidophenyl)-5-mercaptotetrazole (APMT).

In a further aspect of the present invention, there is provided a black and white graphic arts film comprising a support having thereon at least one emulsion layer, said emulsion layer comprising:

(i) SMe-TAI;
(ii) a red spectral sensitising dye;
(iii) at least one anti-foggant; and
(iv) a photosensitive silver halide.

This invention further provides a photographic silver halide emulsion suitable for preparing a black and white graphic arts film comprising (i), (ii), (iii) and (iv).

This invention even further provides a photographic silver halide emulsion melt comprising (i), (ii), (iii) and (iv).

Preferably, the red spectral sensitising dye is a trinuclear merocyanine dye as hereinbefore described. Preferably, the at least one antifoggant is an antifoggant as hereinbefore described. Preferably, the photosensitive silver halide is a silver halide as hereinbefore described.

The black and white graphic arts film of the present invention may be either a high-contrast "hard dot" film (hard edges) or a "rapid access" film (softer dots, fuzzy edges).

In one aspect of the present invention, the black and white graphic arts film is a hard dot film. In this embodiment of the present invention, a nucleator and, preferably, an amine booster, are present in the emulsion layer. Suitable nucleators and amine boosters will be readily apparent to the person skilled in the art. Preferably, the hard dot film has a nucleator of formula (II) and an amine booster of formula (III) present in a gel interlayer. A nucleator and booster are not required for "rapid access" film.

Formula (II)
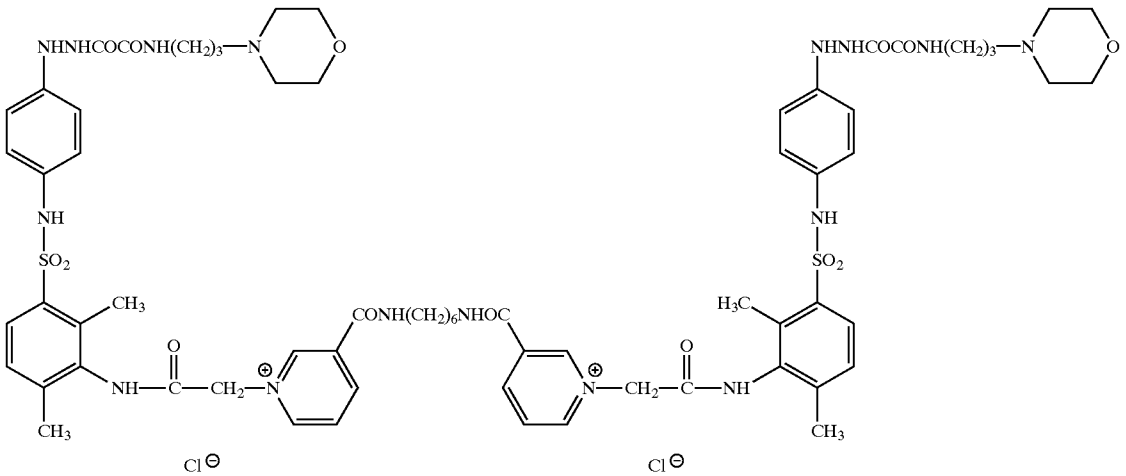
Formula (III)
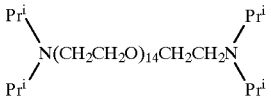

The emulsion layer is coated onto a support, for example, an ESTAR® support, in the black and white graphic arts film of the present invention. The emulsion layer may be separated from the support by an antihalation layer. Alternatively, the support may have an antihalation layer backing. Other layers envisaged in this invention include a gel interlayer and a protective supercoat.

The silver halide emulsions are well known in the art. Silver halide emulsions generally include a vehicle for coating the emulsion as a layer of a photographic element. Useful vehicles include both naturally occurring substances such as proteins, protein derivatives, cellulose derivatives (e.g. cellulose esters), gelatin (e.g. alkali-treated gelatin such as cattle bone or hide gelatin, or acid-treated gelatin such as pigskin gelatin), gelatin derivatives (e.g. acetylated gelatin) and phthalated gelatin. Also useful as vehicle or vehicle extenders are hydrophilic water-permeable colloids. These include synthetic polymeric peptizers, carriers and/or binders such as poly(vinyl alcohol), poly(vinyl lactams), acrylamide polymers, polyvinyl acetals, polymers of alkyl and sulfoalkyl acrylates and methacrylates, hydrolysed polyvinyl acetates, polyamides, polyvinyl pyridine and methacrylamide copolymers.

A preferred embodiment of the present invention is now described, by way of example, with reference to the accompanying Figures in which.

EXAMPLE 1

The film coating in this Example consisted of an ESTAR® support, an antihalation layer on the back of the support on which was coated a latent image forming emulsion layer, a gel interlayer and a protective supercoat.

The latent image forming emulsion layer consisted of a 70:30 chlorobromide cubic dispersed emulsion (0.16 $\mu$m edge length) doped with a rhodium salt at 0.132 mg/Ag mole and an iridium salt at 0.29 mg/Ag mole. It was then chemically sensitised with sulphur and gold and spectrally sensitised with 400 mg/Ag mole of sensitising dye of the formula:

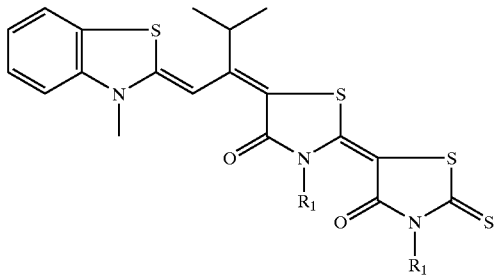

$R_1 = CH_2CO_2H$

The emulsion was coated at a laydown of 2.8 g Ag/m$^2$ in a vehicle of 1.4 g/m$^2$ gel and 0.42 g/m$^2$ latex copolymer of methyl acrylate, the sodium salt of 2-acrylamido-2-methylpropane sulphonic acid and 2-(methacryloyloxy)-ethylacetoacetate (88:5:7 by weight). 2-Methylthio-4-hydroxy-6-methyl-1,3,3a,7-tetraazaindene was then added in addition to the antifoggants 5-carboxy-2-methylthio-4-hydroxy-6-methyl-1,3,3a,7-tetraazaindene (Sme-carboxy-TAI) at 0.65 g/Ag mole and 1-(3-acetamidophenyl)-5-mercaptotetrazole at 0.023 g/Ag mole. A thickener was added to achieve the required viscosity.

The interlayer was coated at a gel laydown of 0.65 g/m$^2$ and included 10 mg/m$^2$ nucleator (structure I) and 60 mg/m$^2$ amine booster (structure II).

Structure I
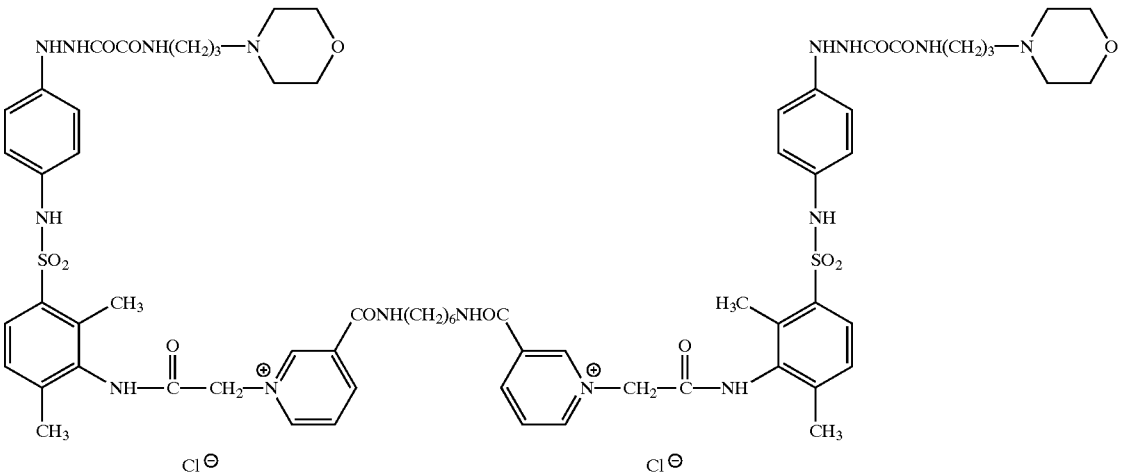
Structure II
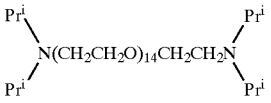

The supercoat contained matte beads and surfactant, and was coated at a gel laydown of 1 $m^2$.

The antihalation layer on the back of the support was then removed using bleach (thereby to remove the light-absorbing dyes therein), and the samples were then measured for total transmittance and total reflectance on a Cary 5 spectrophotometer. Absorptance was then calculated as A=1−(R+T) where A=Absorptance, R=Reflectance and T=Transmittance.

Figure 1:
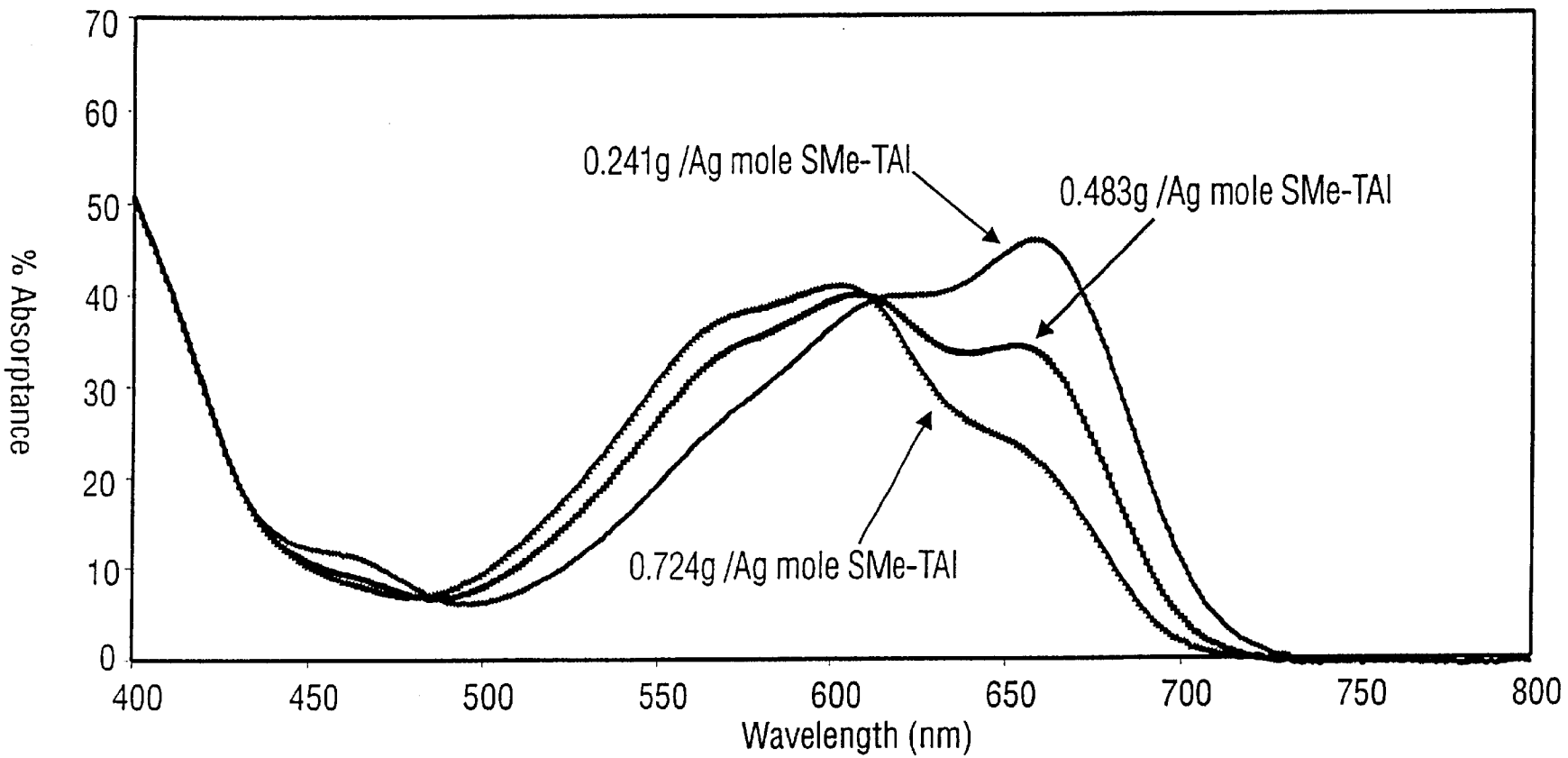
FIG. 1 is an absorptance spectrum showing the effect of 2-methylthio-4-hydroxy-6-methyl-1,3,3a,7-tetraazaindene (SMe-TAI) level on absorptance of a spectral sensitising dye of formula (I).

The absorptance spectra at different levels of 2-methylthio-4-hydroxy-6-methyl-1,3,3a,7-tetraazaindene are shown in FIG. 1.

Table 1 shows the % absorptance at 633 nm and 670 nm. The HN (633 nm) and LD (670 nm) speeds were also calculated.

TABLE 1

| SMe-TAI (g/Ag mole) | % Absorptance @ 633 nm | HN Sp @ 0.6 (LogE) | % Absorptance @ 670 nm | LD Sp @ 0.6 (LogE) |
|---|---|---|---|---|
| 0.241 | 40.33 | 0.94 | 41.24 | 1.00 |
| 0.483 | 33.88 | 0.87 | 27.70 | 0.90 |
| 0.724 | 27.98 | 0.63 | 16.57 | 0.57 |

Table 1 and FIG. 1 show that the % absorptance and speed can be changed dramatically by varying the amount of SMe-TAI in the emulsion layer.

Furthermore, Table 1 and FIG. 1 show that the absorptance characteristics of the dye can be changed in such a way that the relationship between HN (633 nm) and LD (670 nm) speed may be chosen to meet the specific needs of the film.

COMPARATIVE EXAMPLE 2

A film coating was prepared in an identical manner with the exception that SMe-TAI was omitted from the emulsion layer.

Figure 2:
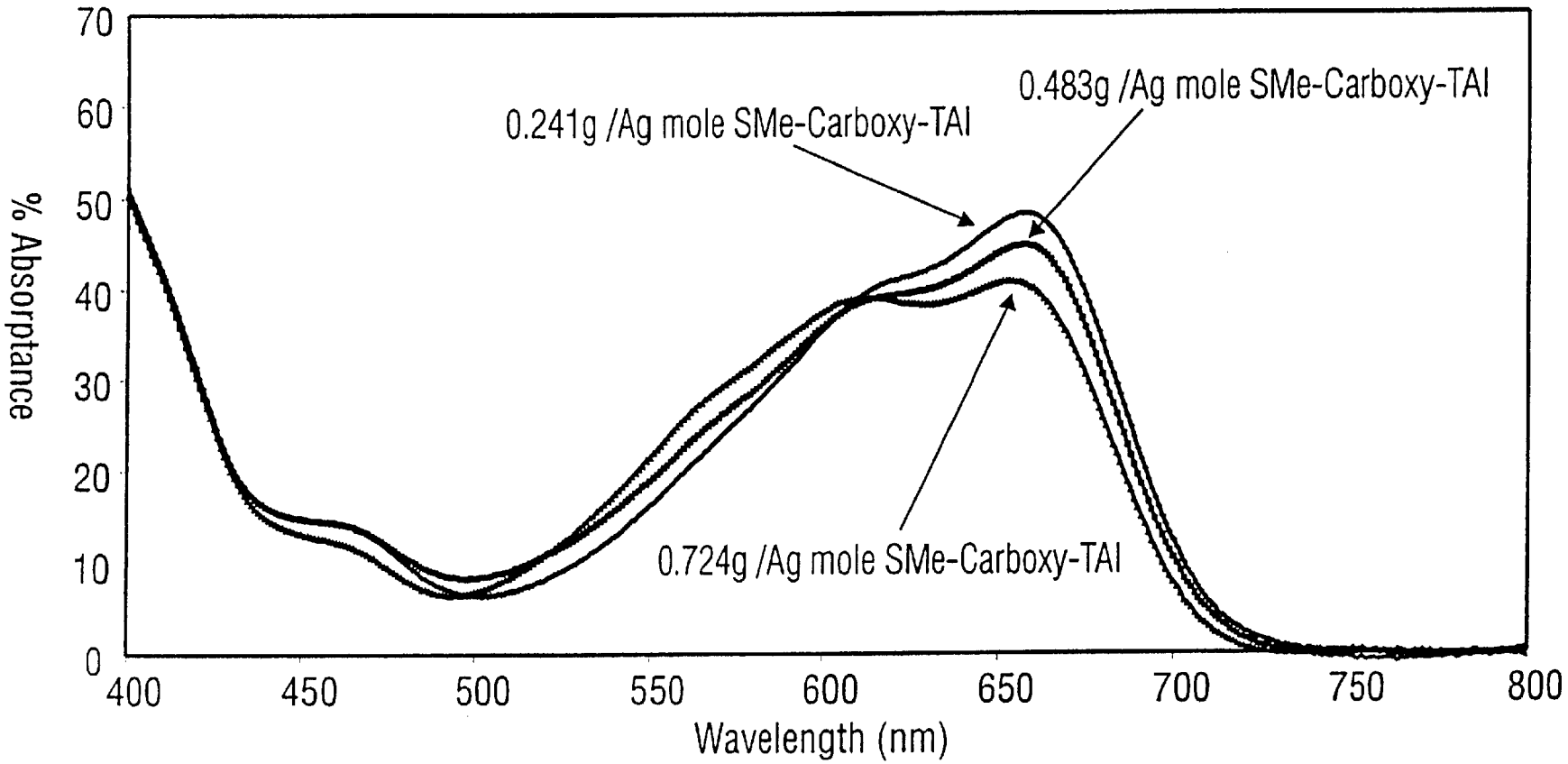
FIG. 2 is an absorptance spectrum showing the effect of 2-methylthio-4-hydroxy-5-carboxy-6-methyl-1,3,3a,7-tetraazaindene (SMe-carboxy-TAI) level on absorptance of a spectral sensitising dye of formula (I).

The absorptance spectra at different levels of 2-methylthio-4-hydroxy-5-carboxy-6-methyl-1,3,3a,7-tetraazaindene are shown in FIG. 2.

Table 2 shows the % absorptance at 633 nm and 670 nm. The HN (633 nm) and LD (670 nm) speeds were also calculated.

TABLE 2

| SMe-Carboxy-TAI (g/Ag mole) | % Absorptance @ 633 nm | HN Sp @ 0.6 (LogE) | % Absorptance @ 670 nm | LD Sp @ 0.6 (LogE) |
|---|---|---|---|---|
| 0.241 | 42.64 | 0.92 | 43.63 | 0.99 |
| 0.483 | 40.29 | 0.86 | 39.99 | 0.94 |
| 0.724 | 38.30 | 0.81 | 34.69 | 0.84 |

Table 2 and FIG. 2 show that the % absorptance and speed cannot be changed significantly by varying the amount of SMe-carboxy-TAI in the emulsion layer. This is in contrast to Example 1 which uses 2-methylthio-4-hydroxy-6-methyl-1,3,3a,7-tetraazaindene in the emulsion layer.

Examples 1 and 2 demonstrate that only by varying the amount of SMe-TAI in the emulsion layer can the absorptance characteristics and, hence, the speed of a trinuclear merocyanine dye be modulated In addition, it has been shown that the relationship between the HN and LD speeds may be changed by varying the amount of SMe-TAI in the emulsion layer. It will be evident that this method of modulating speed will be advantageous in the production of black and white graphic arts film. In particular, the amount of SMe-TAI in the emulsion layer may be used to achieve desired HN and LD speeds with the same trinuclear merocyanine dye.

EXAMPLE 3

An emulsion melt was prepared for a latent image forming emulsion layer in a black and white graphic arts film. The latent image forming emulsion layer consisted of a 70:30 chlorobromide cubic dispersed emulsion (0.16 $\mu$m edge length) doped with a rhodium salt at 0.132 mg/Ag mole and an iridium salt at 0.29 mg/Ag mole. It was then chemically sensitised with sulphur and gold, and spectrally sensitised with 400 mg/Ag mole of sensitising dye of the formula:

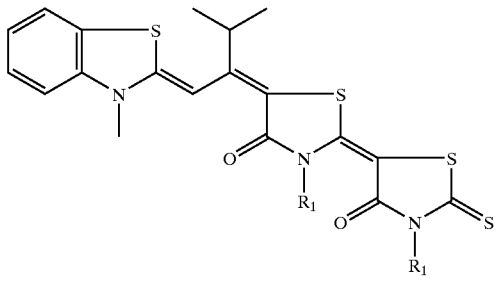

$R_1 = CH_2CO_2H$

The emulsion when coated gave a laydown of 2.8 g Ag/$m^2$ in a vehicle of 1.4 g/$m^2$ gel and 0.42 g/$m^2$ latex copolymer of methyl acrylate, the sodium salt of 2-acrylamido-2-methylpropane sulphonic acid and 2-(methacryloyloxy)-ethylacetoacetate (88:5:7 by weight).

2-Methylthio-4-hydroxy-6-methyl-1,3,3a,7-tetraazaindene (SMe-TAI) was then added to the emulsion melt in addition to the antifoggants, 5-carboxy-2-methylthio-4-hydroxy-6-methyl-1,3,3a,7-tetraazaindene (SMe-carboxy-TAI) at 0.65 g/Ag mole and 1-(3-acetamidophenyl)-5-mercaptotetrazole at 0.023 g/Ag mole. A thickener was added to achieve the required viscosity.

The emulsion melt was held at 40° C. for 16 hours and the speed was measured every hour using DAPER (disposable absorbent paper emulsion response) equipment with the following set up:

| | |
|---|---|
| Exposure | 0.25 seconds |
| Filters | Wr70 + 0 ND |
| Dev Time | 20 seconds |

The DAPER speed was measured for emulsion melts having 0.124, 0.248 and 0.373 g/Ag mole of SMe-TAI added prior to coating.

COMPARATIVE EXAMPLE 4

An emulsion melt was prepared in an identical manner to Example 1, with the exception that SMe-TAI was omitted from the emulsion melt.

Figure 3:
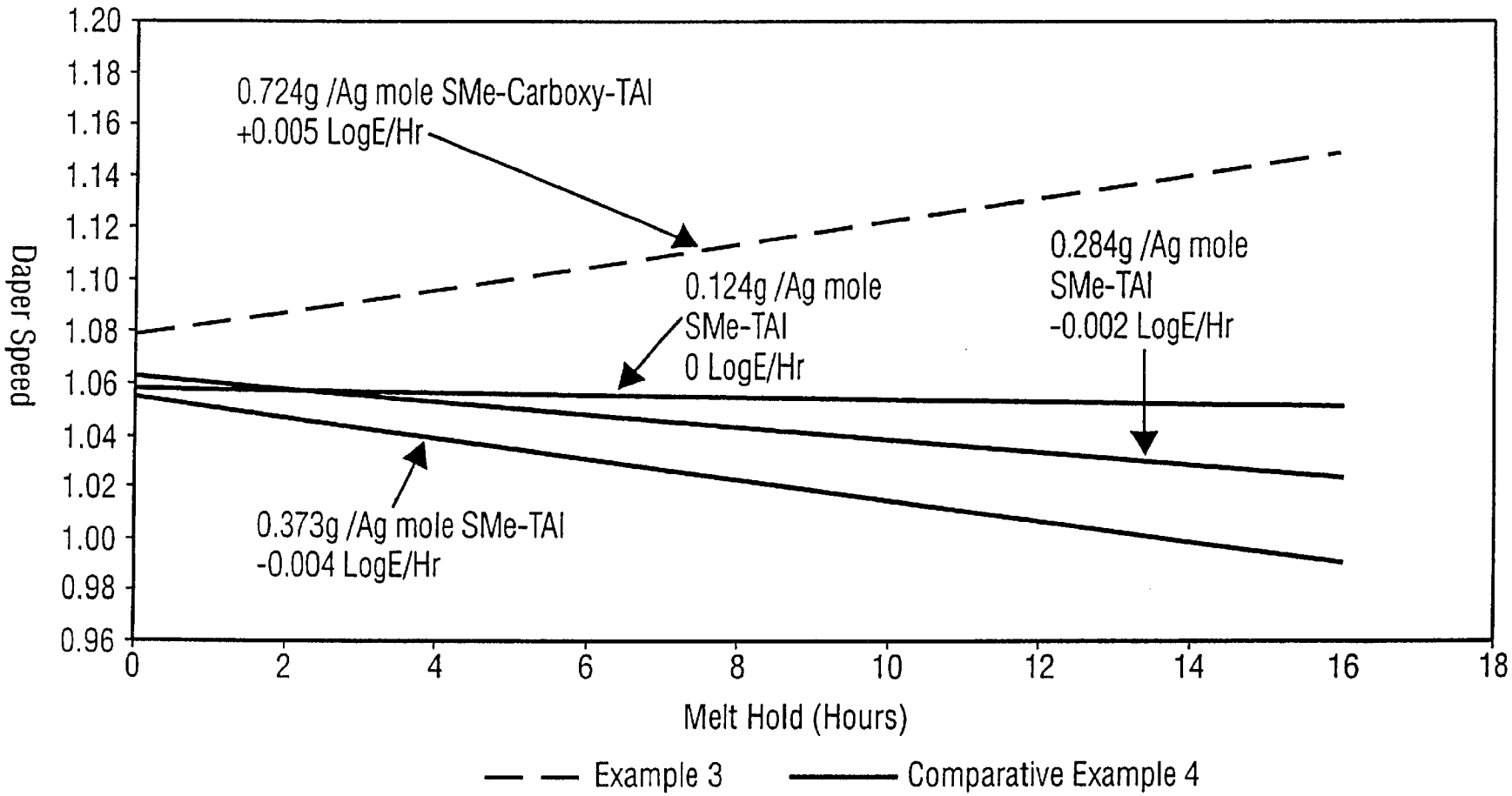
FIG. 3 is a graph showing how Daper (Disposable Absorbent Paper Emulsion Response) speed in an emulsion melt at 40° C. varies over time with SMe-carboxy-TAI and with varying amounts of SMe-TAI.

The results from both Example 3 and Comparative Example 4 are shown in FIG. 3.

FIG. 3 shows that when the antifoggant SMe-carboxy-TAI (Comparative Example 4) is added to the emulsion melt at a level of 0.483 g/Ag mole, the emulsion gains speed over a period of 16 hours at the rate of about 0.005 LogE/h.

However, when SMe-TAI (Example 3) is added at a level of 0.373 g/Ag mole in addition to the other antifoggants, a speed loss is observed over the same period of time. If the level of SMe-TAI is reduced, the speed loss is reduced, until at a level of 0.124 g/Ag mole, the speed of the emulsion remains constant over a period of 16 hours.

Examples 3 demonstrates that SMe-TAI may be used to control emulsion melt drift prior to coating. In a preferred embodiment of this invention, emulsion melt drift may be almost eradicated by the addition of an appropriate amount of SMe-TAI.

This invention is used advantageously in the production of black and white graphic arts films. The control of emulsion melt drift allows the production of photographic films having more reliable qualities. This has obvious advantages from the point of view of the cost of manufacturing black and white graphic arts films.

It will, of course, be understood that the present invention has been described by way of example only and that modifications of detail can be made within the scope of the invention.

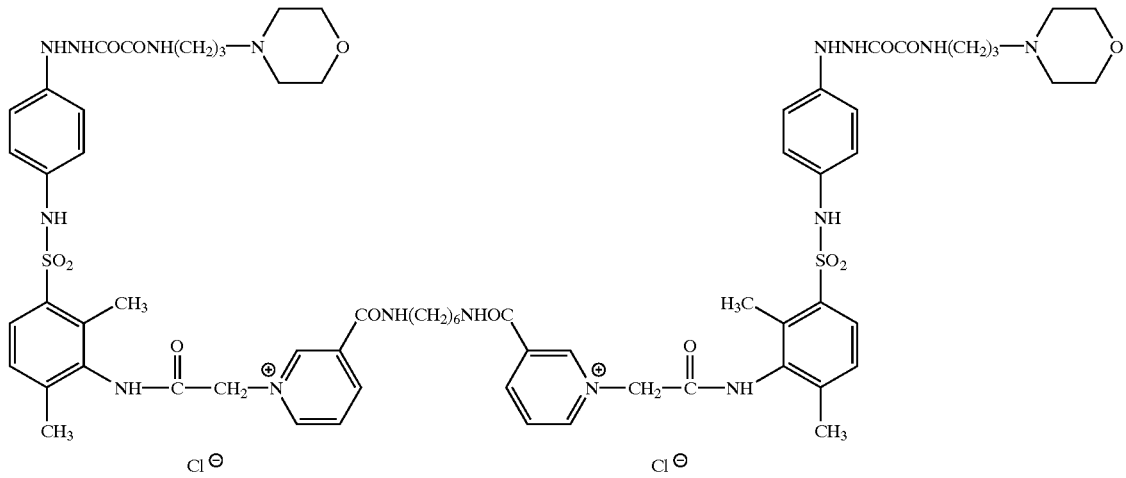

I claim:

1. A black and white graphic arts film comprising a support having thereon at least one emulsion layer, said emulsion layer comprising:

(d) a trinuclear merocyanine spectral sensitising dye;

(e) 2-methylthio-4-hydroxy-6-methyl-1,3,3a,7-tetraazaindene (SMe-TAI); and (f) a photosensitive silver halide.

2. A film according to claim 1 wherein the trinuclear merocyanine dye is of formula (I):

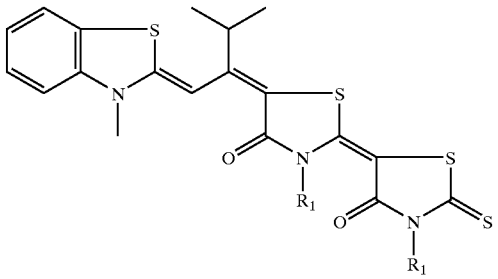

$R_1 = CH_2CO_2H$

3. A film according to claim 1 wherein the concentration of SMe-TAI is in the range of 0.05 to 1.5 g/mole of silver.

4. A film according to claim 1 wherein the silver halide is a 70:30 chlorobromide.

5. A film according to claim 1 wherein the emulsion layer further comprises at least one antifoggant.

6. A film according to claim 5 wherein the antifoggants are 5-carboxy-2-methylthio-4-hydroxy-6-methyl-1,3,3a,7-tetraazaindene and/or 1-(3-acetamidophenyl)-5-mercaptotetrazole.

7. A "hard dot" film according to claim 1 wherein the emulsion layer further comprises a nucleator.

8. A film according to claim 7 wherein the nucleator is of formula:

9. A film according to claim 7 wherein the emulsion layer further comprises an amine booster.

10. A film according to claim 9 wherein the amine booster is of formula:

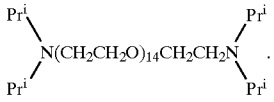

11. A photographic silver halide emulsion suitable for preparing a black and white graphic arts film wherein the emulsion is as defined in claim 1.

12. A photographic silver halide emulsion melt wherein the emulsion melt is as defined in claim 1.

13. A photographic silver halide emulsion melt according to claim 12 wherein the concentration of SMe-TAI in said emulsion melt is in the range of 0.05 to 0.2 g/Ag mole.

14. A black and white graphic arts film comprising a support having thereon at least one emulsion layer, said emulsion layer comprising:

(i) SMe-TAI;

(ii) a red spectral sensitising dye;

(v) at least one anti-foggant; and (vi) a photosensitive silver halide.

15. A method for modulating the relative HN and LD speeds of a black and white graphic arts photographic film comprising combining SMe-TAI in a concentration of from 0.05 to 1.5 g/Ag mole and a trinuclear merocyanine dye in a concentration of from 0.1 to 1.0 g/Ag mole in a silver halide emulsion layer of said film, the concentration of SMe-TAI in said emulsion layer determining the extent of modulation of the relative HN and LD speeds.

16. A method for controlling emulsion melt drift in a photographic silver halide emulsion melt prior to coating said emulsion melt on a support for a photographic film, comprising combining SMe-TAI in a concentration of from 0.05 to 0.5 g/Ag mole and a trinuclear merocyanine dye in a concentration of from 0.1 to 1.0 g/Ag mole in said emulsion melt, the concentration of SMe-TAI in said emulsion melt determining the extent to which the emulsion melt drift is controlled.

* * * * *